US009233787B2

(12) United States Patent
Nakamura

(10) Patent No.: US 9,233,787 B2
(45) Date of Patent: Jan. 12, 2016

(54) CUSHIONING MATERIAL

(71) Applicant: KYOCERA DOCUMENT SOLUTIONS INC., Osaka (JP)

(72) Inventor: Toshiyuki Nakamura, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 265 days.

(21) Appl. No.: 13/775,358

(22) Filed: Feb. 25, 2013

(65) Prior Publication Data

US 2013/0220866 A1 Aug. 29, 2013

(30) Foreign Application Priority Data

Feb. 28, 2012 (JP) ..... 2012-041261

(51) Int. Cl.
*B65D 81/05* (2006.01)
*B65D 81/113* (2006.01)

(52) U.S. Cl.
CPC ..... *B65D 81/054* (2013.01); *B65D 81/055* (2013.01); *B65D 81/056* (2013.01); *B65D 81/113* (2013.01)

(58) Field of Classification Search
CPC ..... B65D 5/445; B65D 5/509; B65D 5/5035; B65D 5/5069; B65D 81/05; B65D 81/053–81/056; B65D 81/107; B65D 81/113; B65D 81/127; B65D 81/1075; B65D 85/30; B65D 85/48; B65D 2313/02; B65D 2585/6835; B65D 2585/6837; B65D 3/006
USPC ..... 206/207, 305, 320, 326, 453, 504, 521, 206/521.6, 523, 586, 588, 591–594, 599
See application file for complete search history.

(56) References Cited

U.S. PATENT DOCUMENTS

| | | | | | |
|---|---|---|---|---|---|
| 3,854,650 | A | * | 12/1974 | Hanaue | 206/521 |
| 4,360,145 | A | * | 11/1982 | Wilcox | 206/586 |
| 4,545,482 | A | * | 10/1985 | Novatny | 206/320 |
| 4,709,817 | A | * | 12/1987 | Keady et al. | 206/523 |
| 4,972,954 | A | * | 11/1990 | Dickie | 206/523 |
| 5,772,025 | A | * | 6/1998 | Chen et al. | 206/320 |
| 6,092,651 | A | * | 7/2000 | Miller | 206/305 |
| 6,569,073 | B1 | * | 5/2003 | Bridges et al. | 493/183 |

(Continued)

FOREIGN PATENT DOCUMENTS

| | | |
|---|---|---|
| JP | 06-27626 U | 4/1994 |
| JP | 2005-324800 | 11/2005 |
| JP | 2006-131294 A | 5/2006 |

*Primary Examiner* — Bryon Gehman
*Assistant Examiner* — Brijesh V. Patel
(74) *Attorney, Agent, or Firm* — Morgan, Lewis & Bockius LLP

(57) ABSTRACT

A cushioning material of the present enclosure includes a base material and columnar support portions, and is arranged between a packed item and an outer box. The base material includes a main body portion which is brought into contact with a cushioned surface of the packed item and a bending part which is formed integrally with the main body portion. The columnar support portions are arranged in a plurality of places on a surface on the opposite side to a surface in contact with the cushioned surface of the base material. At least one of the columnar support portions is fixed to or formed integrally with the bending part such that, when the bending part is bent substantially perpendicularly with respect to the main body portion, all the columnar support portions protrude from the surface of the main body portion by substantially the same height.

4 Claims, 9 Drawing Sheets

(56) References Cited

U.S. PATENT DOCUMENTS

| | | | | |
|---|---|---|---|---|
| 6,868,965 | B2 * | 3/2005 | Miller et al. | 206/320 |
| 2008/0083632 | A1 * | 4/2008 | Reinkensmeyer | 206/326 |
| 2008/0173555 | A1 * | 7/2008 | Horiuchi | 206/207 |
| 2008/0210588 | A1 * | 9/2008 | Stegner et al. | 206/523 |
| 2009/0050511 | A1 * | 2/2009 | Xie et al. | 206/523 |
| 2009/0218248 | A1 * | 9/2009 | Liverman et al. | 206/523 |

* cited by examiner

CUSHIONING MATERIAL

This application is based on and claims the benefit of priority from Japanese Patent Application No. 2012-41261 filed on Feb. 28, 2012, the contents of which are hereby incorporated by reference.

BACKGROUND

The present disclosure relates to a cushioning material that is used, when a relatively heavy product such as an electronic device is packed, to protect the side surfaces, the bottom surface and the top surface of the product.

Conventionally, as a method of packing an electronic device or the like, a method of arranging a cushioning material absorbing an impact and vibrations from the outside during transportation between an outer box such as a corrugated cardboard case and the electronic device (packed item) is generally used. As the cushioning material, a material that is obtained by folding a corrugated cardboard, a pulp-molded cushioning material that utilizes used paper as a material and that can be recycled or the like is used.

However, for the purpose of packing a heavy item, a cushioning material is widely used that includes: a base material which is formed with a corrugated cardboard and a sheet material made of a foamed resin; and a plurality of columnar support portions which are formed integrally with or fixed to the base material.

In the packing using the cushioning material described above, in general, the base material is in contact with the side surfaces of the packed item to be cushioned, the columnar support portions are arranged on portions, having a high strength, of the side surfaces of the packed item and the side surfaces of the packed item are received by the entire surface of the base material.

For example, a packing material is known in which a cross-shaped sheet formed with a corrugated cardboard sheet is wound, in a sleeve shape, around a fan attachment frame that is a packed item, and then they are bound with a binding material; a stacked core (columnar support portion) fitted to the holder surface of the cross-shaped sheet (base material) is used to hold the back surface of a flange portion of the fan attachment frame, and thus the resistance to a compression load is enhanced.

However, depending on the packed item, it is likely that a portion strong enough to have the columnar support portion arranged is not present on a surface to be cushioned or the area of a portion having a high strength is small, with the result that it may be impossible to arrange the cushioning material. In order to overcome this problem, it is necessary to cover the packed item with a foamed cushioning sheet or fill the gap between the packed item and an outer box with foamed resin chips, and thus the amount of cushioning material used is increased. Consequently, the packing cost is increased, and it is not preferable in terms of environment load.

One way is to increase the size of the base materials compared with the surface of the packed item to be cushioned and arrange the columnar support portion outside the outer edge portion of the packed item. However, when a load is applied to the columnar support portion, the base material is bent at a joint portion to the inner edge of the columnar support portion, and the columnar support portion falls to the side of the packed item, with the result that it is disadvantageously impossible to obtain a sufficient cushioning effect.

SUMMARY

An object of the present disclosure is to provide a cushioning material that can cushion an external force sufficiently and reduce the amount of cushioning material used even when a portion having a high strength is not present in the surface of a packed item to be cushioned.

A cushioning material according to a first aspect of the present disclosure includes a base material and columnar support portions, and is arranged between a packed item and an outer box. The base material includes a main body portion which is brought into contact with a cushioned surface of the packed item and a bending part which is formed integrally with the main body portion so as to be able to be bent through a hinge line, and is arranged opposite the packed item. The columnar support portions are arranged in a plurality of places on a surface on the opposite side to a surface in contact with the cushioned surface of the base material. At least one of the columnar support portions is fixed to or formed integrally with the bending part such that, when the bending part is bent substantially perpendicularly with respect to the main body portion so as to be brought into contact with another surface adjacent to the cushioned surface, all the columnar support portions protrude from the surface of the main body portion by substantially the same height.

Yet other objects of the present enclosure and specific advantages obtained by the present enclosure will be further obvious from the description of embodiments discussed below.

DETAILED DESCRIPTION

Figure 1:
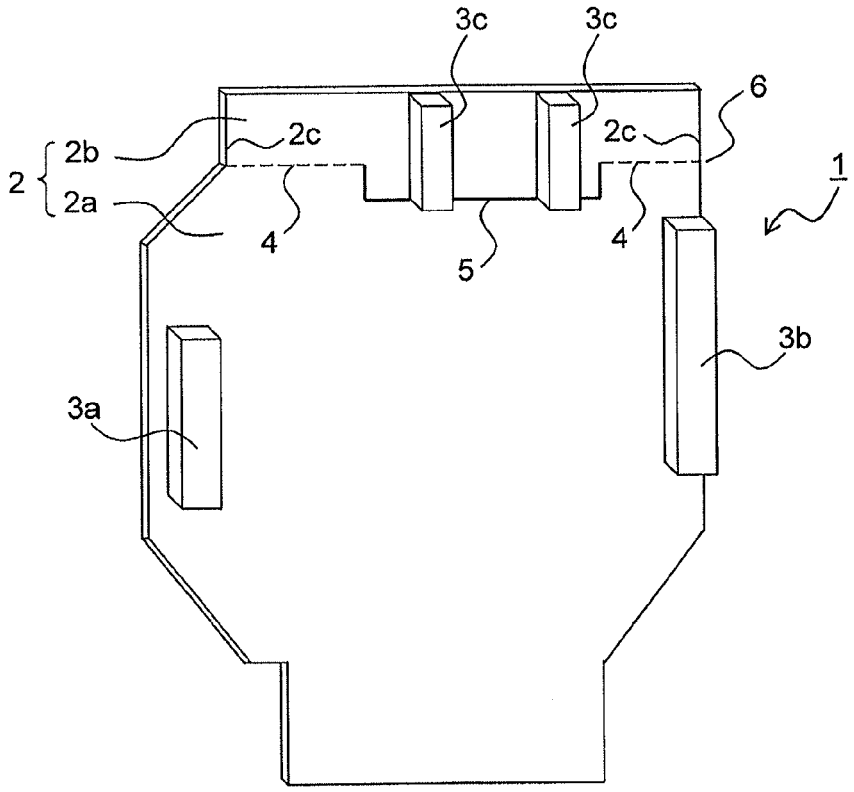
FIG. 1 is a perspective view of a cushioning material 1 according to a first embodiment of the present disclosure.

Embodiments of the present enclosure will be described below with reference to accompanying drawings. FIG. 1 is a perspective view of a cushioning material 1 according to a first embodiment of the present disclosure. The cushioning material 1 is formed with: a base material 2 that is formed with a corrugated cardboard sheet and that is in contact with the side surface 7*a* (see FIG. 4) of an electronic device (packed item) 7; and columnar support portions 3*a*, 3*b* and 3*c* that are formed of a stacked corrugated cardboard and that are fixed to a plurality of places (here, four places) on a surface on the opposite side to the surface in contact with the side surface 7*a* of the base material 2. In the cushioning material 1, the base material 2 is bent to alleviate the transmission of an impact to the electronic device 7.

In an upper portion of the base material 2, a hinge line 6 is made that is formed with two bending lines 4 extending inwardly from left and right edges 2*c* and a cut line 5 which connects the bending lines 4, which is convex inwardly (in a direction of a main body portion 2*a*) and which is U-shaped as seen in plan view. The base material 2 is divided into the main body portion 2*a* and a bending part 2*b* that can be bent along the hinge line 6 with respect to the main body portion 2*a*. Examples of the bending line 4 include a fold line, perforations and a half-cut line.

The columnar support portions 3*a* and 3*b* are arranged on the inner sides of the left and right edges of the main body portion 2*a* in an up/down direction; the columnar support portions 3*c* are arranged in two places of the bending part 2*b*, extending from the upper end to the lower end in the up/down direction. The columnar support portions 3*a* to 3*c* may be formed by stacking corrugated cardboard sheet parts vertically with respect to the base material 2 or may be formed by stacking corrugated cardboard sheet parts horizontally with respect to the base material 2. The base material 2 is formed with a corrugated cardboard sheet and the columnar support portions 3*a* to 3*c* are formed of a stacked corrugated cardboard, and thus it is possible to obtain the cushioning material 1 in which it is not necessary to separate the base material 2 and the columnar support portions 3*a* to 3*c* at the time of disposal, it is possible to recycle them and the amount of environment load is low.

Figure 2:
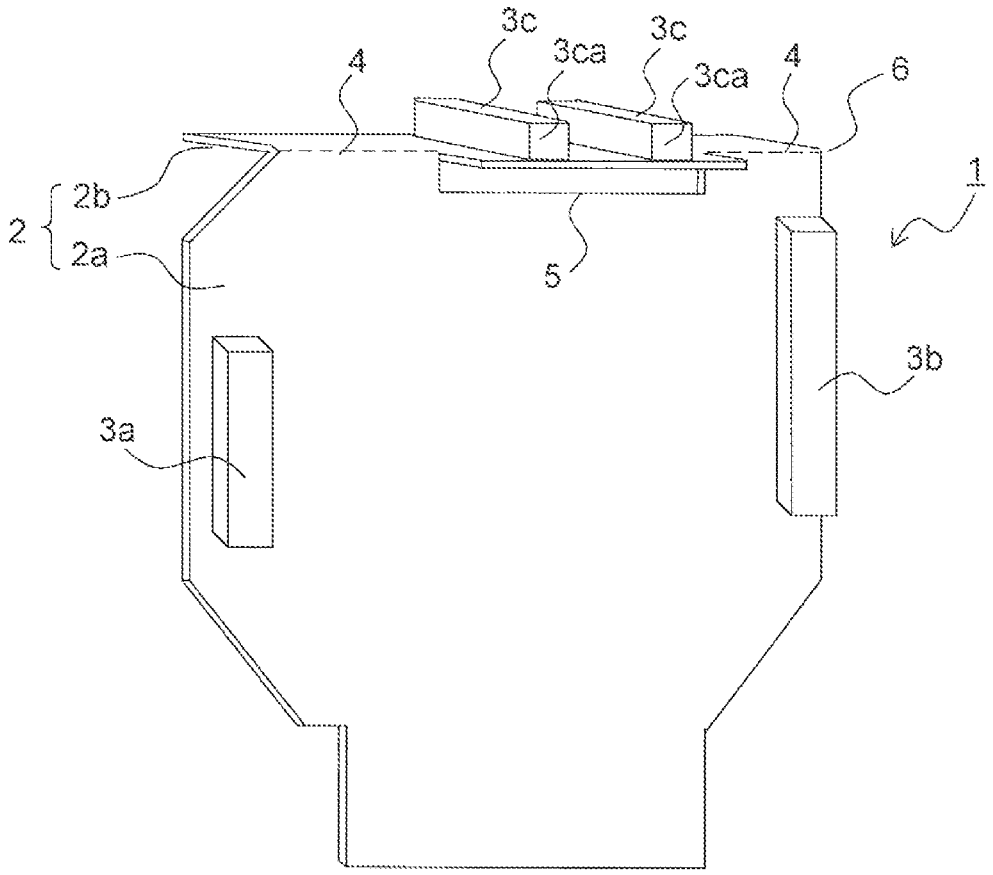
FIG. 2 is a perspective view showing a state where a bending part 2*b* of the cushioning material 1 of the first embodiment is bent substantially perpendicularly with respect to a main body portion 2*a;*

A method of using the cushioning material 1 of the present embodiment will now be described. FIG. 2 is a perspective view showing a state where the bending part 2*b* of the cushioning material 1 of the first embodiment is bent substantially perpendicularly with respect to the main body portion 2*a*. When the cushioning material 1 is used, as shown in FIG. 2, the bending part 2*b* is bent along the hinge line 6 such that the columnar support portions 3*c* face upwardly, and thus the base material 2 is L-shaped as seen from the side surface. In this way, in a lower end portion of the bending part 2*b*, its approximate center portion is cut to rise along the cut line 5 and protrudes in the same direction of the columnar support portions 3*a* and 3*b*. The end surfaces 3*ca* of the columnar support portions 3*c* fixed to the bending part 2*b* also protrude, together with the bending part 2*b*, in the same direction of the columnar support portions 3*a* and 3*b*. Here, the columnar support portions 3*c* protrude, from the surface of the main body portion 2*a*, by a distance substantially equal to the height of the columnar support portions 3*a* and 3*b*.

Figure 3:
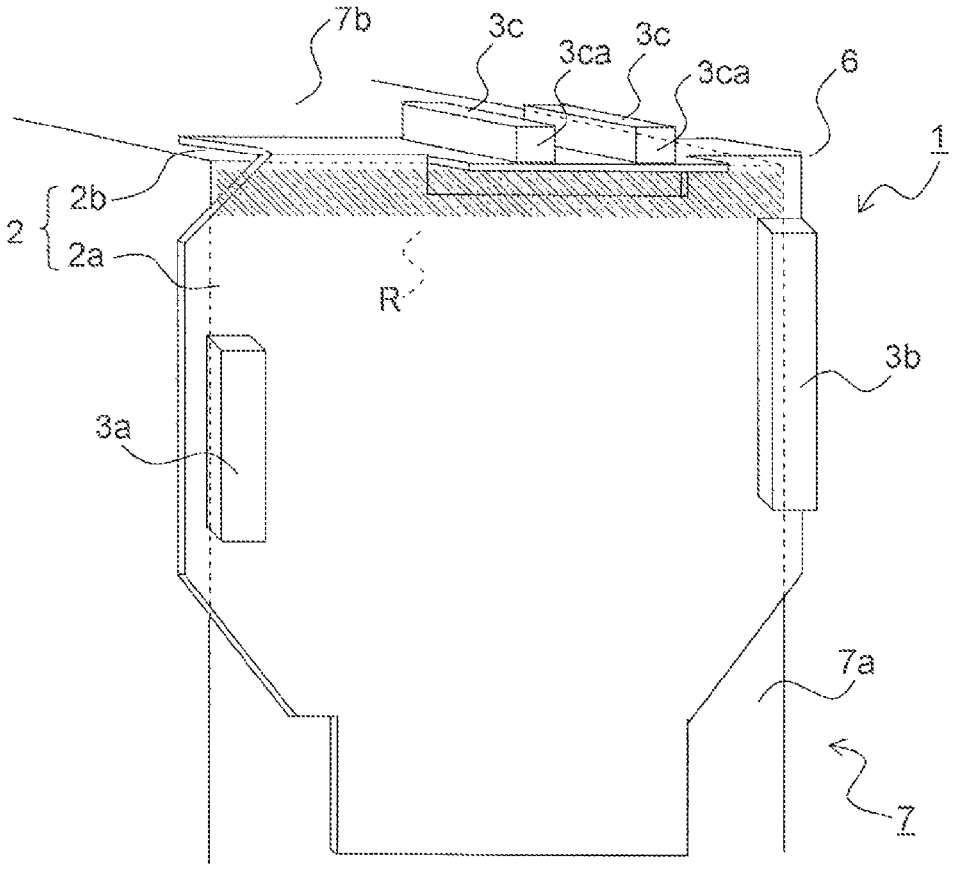
FIG. 3 is a perspective view showing a state where the cushioning material 1 of the first embodiment bent as shown in FIG. 2 is fitted along the side surface 7*a* of an electronic device 7.
Figure 4:
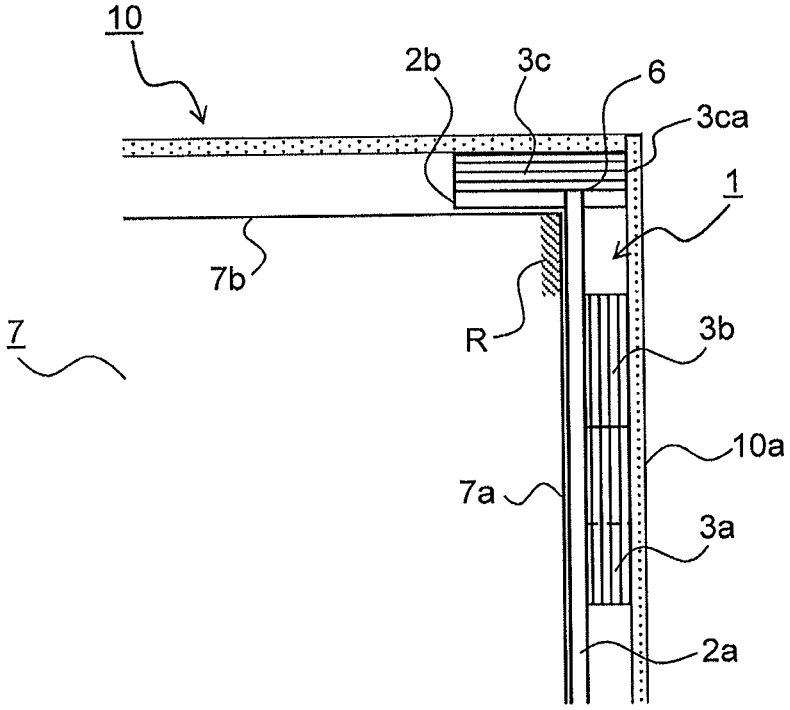
FIG. 4 is a partial side view when the cushioning material 1 of the first embodiment is fitted to the side surface 7*a* and the electronic device 7 packed into an outer box 10 is seen from the left direction of FIG. 3.

FIG. 3 is a perspective view showing a state where the cushioning material 1 of the first embodiment bent as shown in FIG. 2 is fitted along the side surface 7*a* of the electronic device 7; FIG. 4 is a partial side view when the cushioning material 1 of the first embodiment is fitted to the side surface 7*a* and the electronic device 7 packed into an outer box 10 is seen from the left direction of FIG. 3. Since, in the electronic device 7, a frame (not shown) is present in the vicinity of left and right side edge portions of the side surface (cushioned surface) 7*a* opposite the columnar support portions 3*a* and 3*b*, the strength thereof is high. On the other hand, the frame is not present in a region R (represented by hatching in FIG. 3) in the vicinity of the upper end portion of the side surface 7*a*, and the strength thereof is low. Hence, when the columnar support portions 3*c* are arranged opposite the region R whose strength is low, the region R may be deformed or damaged at the time of the application of an external force such as a load or an impact.

Hence, in the present embodiment, the bending part 2*b* of the cushioning material 1 is bent along a corner portion of the electronic device 7, which is the packed item, substantially perpendicularly with respect to the main body portion 2*a* such that the bending part 2*b* is arranged along the upper surface 7*b* of the electronic device 7, and thus the end surfaces 3*ca* of the columnar support portions 3*c* protruding from the surface of the main body portion 2*a* are brought into contact with the side plate 10*a* of the outer box 10. In this configuration, the columnar support portions 3*c* are arranged above the upper surface 7*b* (outside the side surface 7*a*) of the electronic device 7, and the columnar support portions 3*c* are not present in the position opposite the region R. Consequently, even when an external force is applied from the direction of the side plate 10*a*, since the external force is received through the columnar support portions 3*a* and 3*b* by the frame or is received by the bending portion between the main body portion 2*a* and the bending part 2*b*, the load is not applied to the region R. Thus, it is possible to prevent the deformation and the damage of the region R whose strength is low in the side surface 7*a*. Moreover, the columnar support portions 3*a* to 3*c* are arranged in the vicinity of the three edges, that is, the left and right side edges and the upper edges of the base material 2, and, when the cushioning material 1 is fitted along the side surface 7*a*, since the three edges, that is, the left and right side edges and the upper edges of the base material 2 are supported by the columnar support portions 3*a* and 3*b* and the end surfaces 3*ca* of the columnar support portions 3*c*, the base material 2 is not bend more than necessary.

Moreover, since the side portions of the columnar support portions 3*c* are arranged along the upper surface 7*b* adjacent to the side surface 7*a*, the columnar support portions 3*c* are prevented from falling inwardly (to the side of the electronic device 7). Furthermore, since the external force is applied to the columnar support portions 3*c* in a direction (the left/right direction of FIG. 4) parallel to a joint surface to the bending part 2*b*, the cushioning material 1 receives the external force by the entire area of the portion of the hinge line 6 of the base material 2. Thus, it is possible to reliably cushion a load or an impact applied to the side surface 7*a* without the area of the columnar support portions 3*c* being increased, and it is also possible to reduce the manufacturing cost of the cushioning material 1.

The amount of protrusion of the convex portion of the cut line 5 is made equal to the height of the columnar support portions 3*a* and 3*b*, and the edges of the columnar support portions 3*c* on the side of the cut line 5 are fixed to the bending part 2*b* along the convex portion of the cut line 5, and thus when the columnar support portions 3*c*, which are members separate from the base material 2, are adhered and fixed to the bending part 2*b*, it is possible to apply an adhesive to the entire back surface of the columnar support portions 3*c*, with the result that the workability of the assembly is enhanced.

Figure 5:
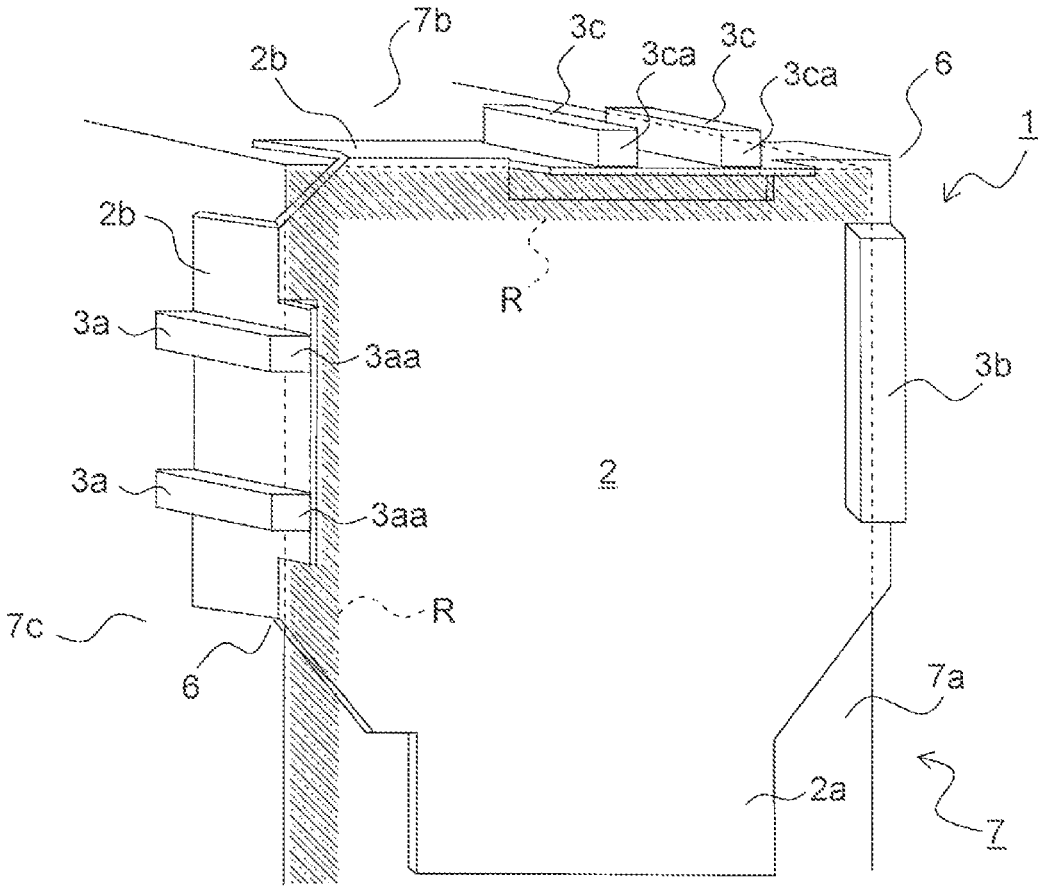
FIG. 5 is a perspective view showing a state where the cushioning material 1 according to a second embodiment of the present disclosure is fitted along the side surface 7*a* of the electronic device 7.
Figure 6:
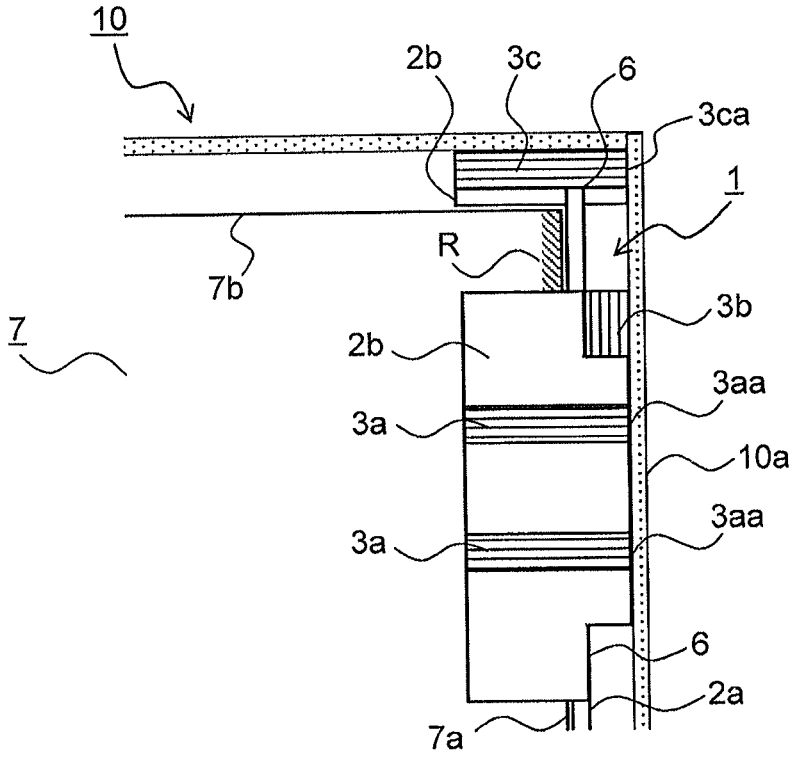
FIG. 6 is a partial side view when the cushioning material 1 according to the second embodiment is fitted to the side surface 7*a* and the electronic device 7 packed into the outer box 10 is seen from the left direction of FIG. 5.

FIG. 5 is a perspective view showing a state where the cushioning material 1 according to a second embodiment of the present disclosure is fitted along the side surface 7*a* of the electronic device 7; FIG. 6 is a partial side view when the cushioning material 1 according to the second embodiment is fitted to the side surface 7*a* and the electronic device 7 packed into the outer box 10 is seen from the left direction of FIG. 5. Since, in the electronic device 7 shown in FIG. 5, the frame (not shown) is present in the vicinity of the right side edge portion of the side surface 7*a* opposite the columnar support portion 3*b*, the strength thereof is high. On the other hand, the frame is not present in regions R (represented by hatching in FIG. 5) in the vicinity of the upper end portion and the right side edge portion, the strength thereof is low.

Hence, in the present embodiment, the bending parts 2*b* are provided in two places of the upper portion and the left side portion of the base material 2. Each of the bending parts 2*b* is bent substantially perpendicularly with respect to the main body portion 2*a* such that the bending parts 2*b* are arranged along the upper surface 7*b* and the side surface 7*c* of the electronic device 7. Thus, the end surfaces 3*aa* of the columnar support portions 3*a* and the end surfaces 3*ca* of the columnar support portions 3*c* protruding from the surface of the main body portion 2*a* are brought into contact with the side plate 10*a* of the outer box 10.

In this configuration, since the columnar support portions 3*a* and 3*c* are not present in the position opposite the regions R, even when an external force is applied from the direction of the side plate 10*a*, the load is not applied to the regions R. Thus, it is possible to prevent the deformation of the regions R whose strength is low in the side surface 7*a*. Moreover, since the three edges, that is, the left and right side edges and the upper edges of the base material 2 are supported by the columnar support portion 3*b*, the end surfaces 3*aa* of the columnar support portions 3*a* and the end surfaces 3*ca* of the columnar support portions 3*c*, the base material 2 is unlikely to be deformed as compared with a configuration in which only two opposite edges are supported.

Moreover, since the columnar support portions 3*a* are arranged along the side surface 7*c* and the columnar support portions 3*c* are arranged along the upper surface 7*b*, the columnar support portions 3*a* and 3*c* are prevented from falling inwardly (to the side of the electronic device 7). Furthermore, since an external force is applied to the columnar support portions 3*a* and 3*c* in a direction (the left/right direction of FIG. 6) parallel to a joint surface to the bending part 2*b*, the cushioning material 1 receives the external force by the entire ridge line of the portion of the hinge line 6 of the base material 2. Thus, as in the first embodiment, it is possible to reliably cushion a load or an impact applied to the side surface 7*a* without the area of the columnar support portions 3*a* and 3*c* being increased.

Although, in the present embodiment, the configuration in which the bending parts 2*b* are provided continually in the two places of the upper portion and the left side portion of the base material 2 has been described, even when the flame is not present in the vicinity of the right side edge portion opposite the columnar support portion 3*b* of the side surface 7*a* and the strength thereof is low, a bending part 2*b* where the columnar support portion 3*b* is arranged is preferably provided continuously on the right side portion of the base material 2.

Figure 7:
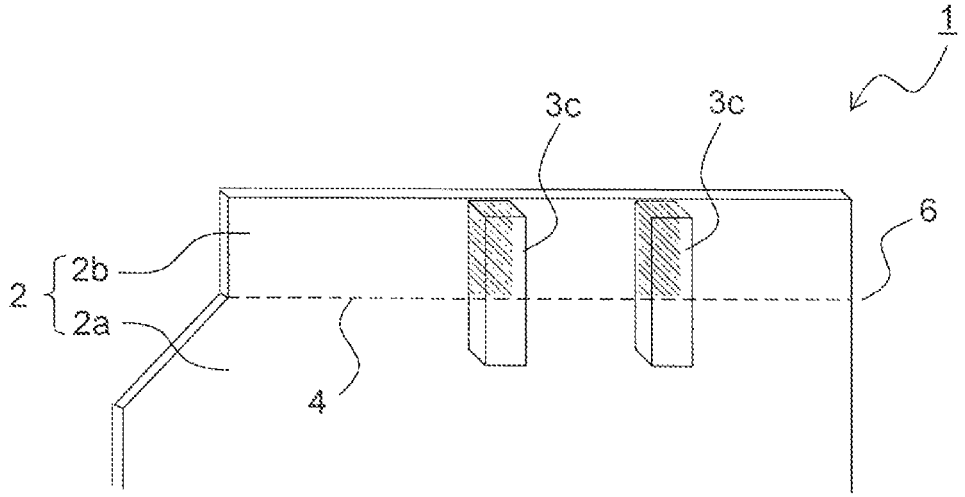
FIG. 7 is a partial perspective view showing a variation of the cushioning material 1 of the first and second embodiments.

FIG. 7 is a partial perspective view showing a variation of the cushioning material 1 of the first and second embodiments. In the cushioning material 1 shown in FIG. 7, the hinge line 6 between the bending part 2*b* and the main body portion 2*a* is formed with a straight bending line 4. In the columnar support portions 3*c*, only portions (represented by hatching in FIG. 7) extending from the upper end to the lower end of the bending part 2*b* are adhered, and the portions protruding beyond the hinge line 6 to the side of the main body portion 2*a* are not adhered.

Figure 8:
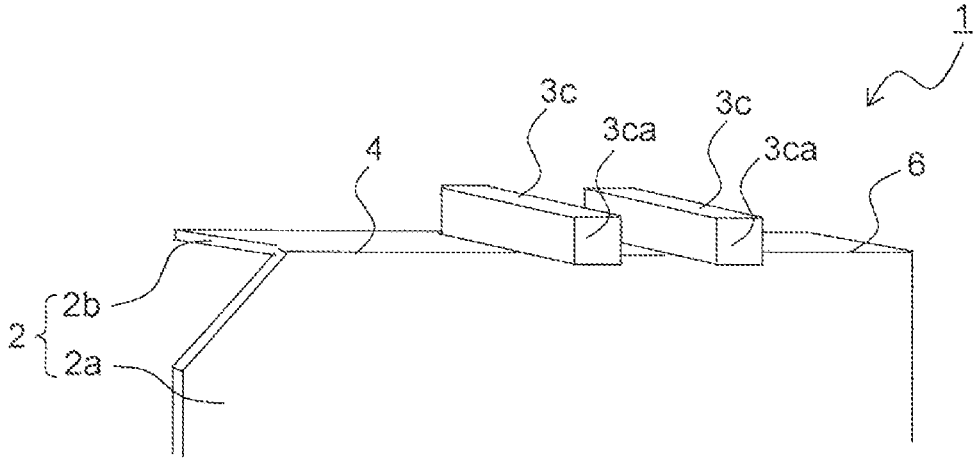
FIG. 8 is a partial perspective view showing a state where the bending part 2*b* of the cushioning material 1 shown in FIG. 7 is bent substantially perpendicularly with respect to the main body portion 2*a;*

FIG. 8 is a partial perspective view showing a state where the bending part 2*b* of the cushioning material 1 shown in FIG. 7 is bent substantially perpendicularly with respect to the main body portion 2*a*. When the cushioning material 1 is used, as shown in FIG. 8, the bending part 2*b* is bent along the hinge line 6 such that the columnar support portions 3*c* face upwardly, and thus the base material 2 is L-shaped as seen from the side surface. In this way, the end surfaces 3*ca* of the columnar support portions 3*c* that are not fixed to the main body portion 2*a* protrude, in the same direction as the columnar support portions 3*a* and 3*b*, by a distance substantially equal to the height of the columnar support portions 3*a* and 3*b*.

Since, in the configuration shown in FIGS. 7 and 8, the hinge line 6 is formed continuously across the direction of the width of the side surface 7*a* and the contact area between the main body portion 2*a* and the side surface 7*a* is increased, a load and an impact are uniformly distributed over the side surface 7*a*, and thus it is possible to more reliably perform the cushioning. However, it is necessary to apply an adhesive to only the adhesion portions (the hatched portions in FIG. 7) of the back surface of the columnar support portions 3*c*, and thus an operation of applying the adhesive is complicated. The adherence area between the bending part 2*b* and the columnar support portions 3*c* is decreased. Hence, in terms of the workability of the assembly of the cushioning material 1 and the strength of the columnar support portions 3*c*, the configuration which is shown in FIGS. 1 to 6 and in which the adhesive can be applied to the entire back surface of the columnar support portions 3*c* is preferably used.

Figure 9:
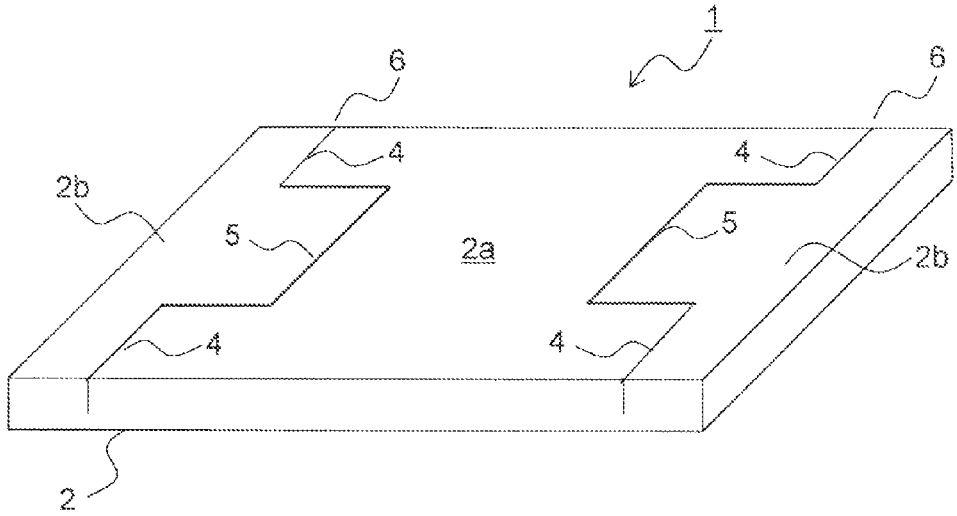
FIG. 9 is a perspective view of the cushioning material 1 according to a third embodiment of the present enclosure.
Figure 10:
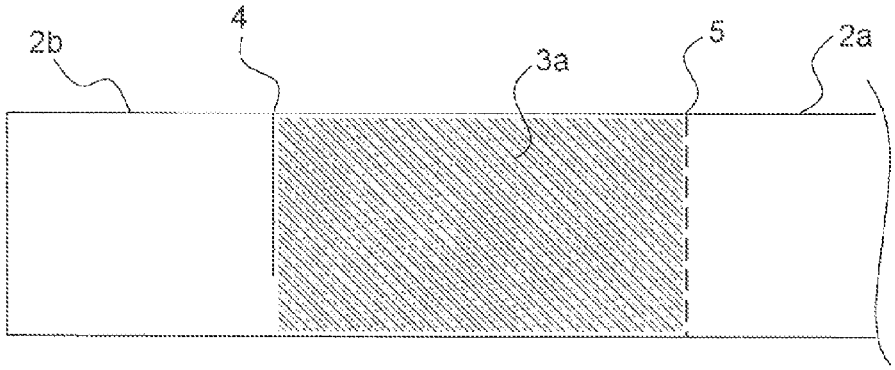
FIG. 10 is a partial side view of the vicinity of the bending part 2*b* of the cushioning material 1 shown in FIG. 9 and according to the third embodiment.

FIG. 9 is a perspective view of the cushioning material 1 according to a third embodiment of the present disclosure; FIG. 10 is a partial side view of the vicinity of the bending part 2*b* of the cushioning material 1 shown in FIG. 9. In FIG. 10, the bending part 2*b* on the left side of FIG. 9 is shown; the bending part 2*b* on the right side of FIG. 9 is configured as in FIG. 10 (bilateral symmetry). In the cushioning material 1 of the present embodiment, through the hinge line 6 formed with the cut line 5 that is convex in the direction of the main body portion 2*a* formed in the base material 2 made of a foamed resin and that is U-shaped as seen in plan view and the bending line 4 that is formed with half cut lines extending from both ends of the cut line 5 to two opposite sides (two sides in the up/down direction of FIG. 9) of the base material 2, the bending parts 2*b* are provided to continuous with two opposite sides (two sides in the left/right direction of FIG. 9) of the main body portion 2*a*. When the cushioning material 1 is used, the portion (the hatched portion of FIG. 10) sandwiched between the cut lines 5 serves as the columnar support portions 3*a* and 3*b* (see FIG. 11).

Figure 11:
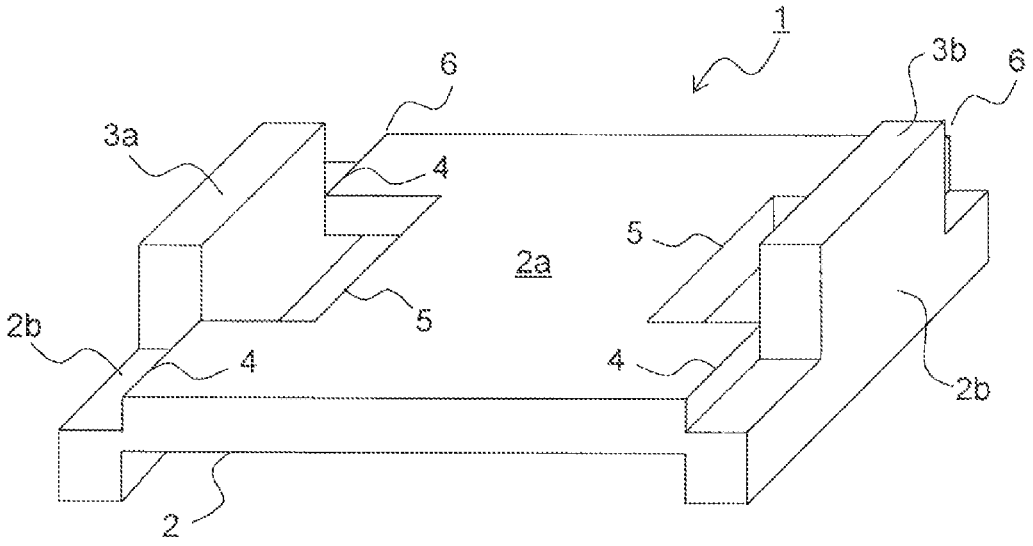
FIG. 11 is a perspective view showing a state where the bending parts 2*b* of the cushioning material 1 of the third embodiment are bent substantially perpendicularly with respect to the main body portion 2*a;*
Figure 12:
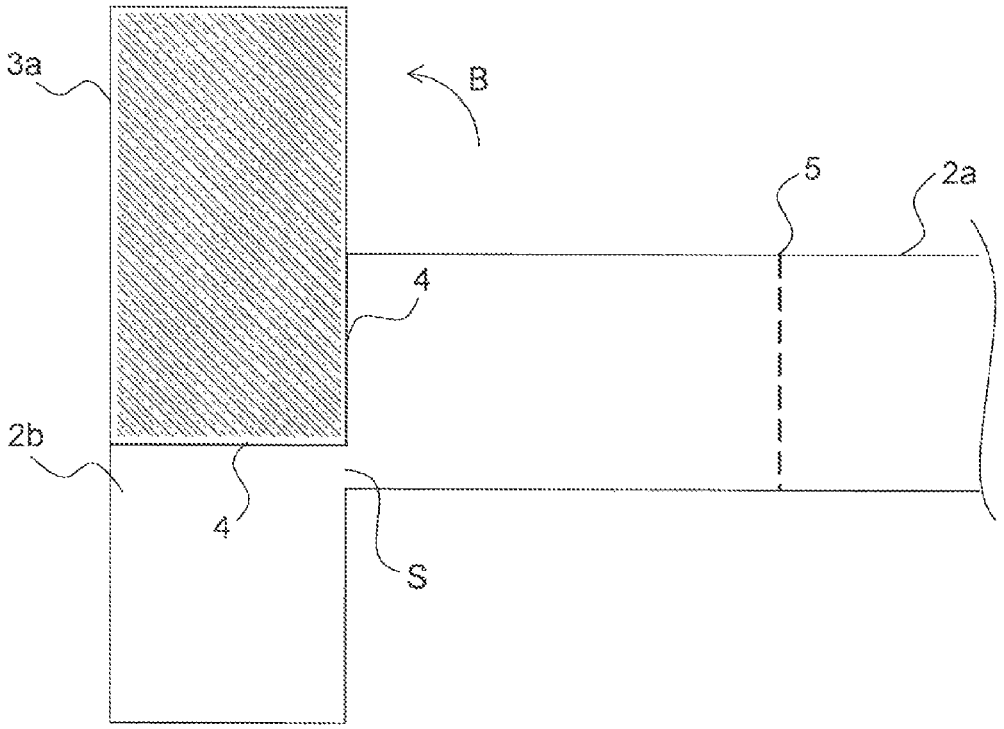
FIG. 12 is a partial side view of the vicinity of the columnar support portion 3*a* of the cushioning material 1 of the third embodiment bent as shown in FIG. 11.

FIG. 11 is a perspective view showing a state where the bending parts 2*b* of the cushioning material 1 of the third embodiment are bent substantially perpendicularly with respect to the main body portion 2*a*; FIG. 12 is a partial side view when the vicinity of the columnar support portion 3*a* of the cushioning material 1 of the third embodiment is seen from the plane of FIG. 11. When the cushioning material 1 is used, the bending parts 2*b* on both sides are bent substantially perpendicularly with respect to the main body portion 2*a* such that the cut sides of the bending lines (half cut lines) 4 face outwardly as shown in FIG. 11. Thus, both sides (the side of the main body portion 2*a* and the side of the bending parts 2*b*) of the bending line 4 are extended substantially perpendicularly, and the portion (the hatched portion of FIG. 12) covered by the cut line 5 is cut to rise, as the columnar support portion 3*a*, from the base material 2 in a direction indicated by an arrow B. Here, the bending parts 2*b* are connected to the main body portion 2*a* through regions S where the bending lines 4 are not formed, and the columnar support portions 3*a* and 3*b* protrude in the same direction (the upward direction of FIG. 11) by the substantially same height.

The cushioning material 1 formed as shown in FIG. 11 is fitted such that the main body portion 2*a* is brought into contact with the side surface 7*a* of the electronic device 7 (see FIG. 3) and that the bending parts 2*b* are arranged along the side surfaces (the side surface 7*c* and the opposite surface of FIG. 3) adjacent to the side surface 7*a*. Then, the electronic device 7 to which the cushioning material 1 is fitted is packed into the outer box 10 (see FIG. 4). Thus, since the columnar support portions 3*a* and 3*b* are not present in the position opposite the side surface 7*a*, even when an external force is applied from the direction of the side plate 10*a*, a load is not applied directly to the side surface 7*a*. Hence, it is possible to prevent the region R whose strength is low from being deformed in the side surface 7*a*.

Since the cushioning material 1 before use is formed in the shape of a flat plate as shown in FIG. 9, and a large number of pieces of cushioning material 1 can be stacked, the form of the transportation of the cushioning material 1 is made compact, and the storage space of the cushioning material 1 is reduced. When the cushioning material 1 is used, the bending parts 2*b* are bent along the hinge lines 6, and thus it is possible to easily assemble the cushioning material 1 having the base material 2 and the columnar support portions 3*a* and 3*b* as shown in FIG. 11.

Furthermore, even in the cushioning material 1 of the present embodiment, the bending parts 2*b* are provided on the three sides of the base material 2, and the bending parts 2*b* are bent, and thus it is possible to provide the columnar support portions 3*a* to 3*c* in the three places of the base material 2 as in the first and second embodiments. In this way, the base material 2 is prevented from being bent more than necessary, with the result that it is possible to obtain the cushioning material 1 having a higher cushioning effect.

As the material of the cushioning material 1, a foamed resin such as a foamed polystyrene or a foamed polyurethane is used. If the foamed resin forming the cushioning material 1 is a material, such as a foamed polystyrene, that has a low elasticity (flexibility), when the bending parts 2*b* are bent, it is likely that the half cut lines are torn more deeply and the regions S are broken. Even if the regions S are not broken at the time of the bending of the bending parts 2*b*, when the cushioning material 1 is placed between the electronic device 7 and the outer box 10, and thereafter an external force is applied to easily break the regions S, it is impossible to obtain a sufficient cushioning effect. Hence, when the cushioning material 1 is likely to receive a large external force, a foamed resin, such as a foamed polyurethane, that has an elasticity (flexibility) is preferably used.

The present enclosure is not limited to the embodiments described above; many modifications are possible without departing from the spirit of the present enclosure. For example, the number, the size, the shape and the height of the bending parts 2*b* and the columnar support portions 3*a* to 3*c* arranged in the base material 2 and the positions where they are arranged in the base material 2 are preferably designed as necessary according to the weight of the electronic device 7, the arrangement of the frame on the cushioned surface and the like. Specifically, even in the cushioning material 1 of the first and second embodiments, as in the third embodiment, only the columnar support portions 3*a* and 3*b* can also be arranged on the two opposite sides of the base material 2 without the columnar support portion 3*c* being arranged. In this case, one or both of the columnar support portions 3*a* and 3*b* are preferably arranged on the bending parts 2*b*.

Although, in the above embodiments, the case where the cushioning material 1 is used for cushioning the side surface 7*a* of the electronic device 7 has been described, the cushioning material I of the present enclosure may be naturally used for cushioning the upper surface or the bottom surface of the electronic device 7.

The present enclosure can be utilized as a cushioning material formed with a base material and a plurality of columnar support portions. Even when a portion having a high strength is not present on the cushioned surface of a packed item, it is possible to provide, by utilizing the present enclosure, a cushioning material that sufficiently cushions an external force, with a simple configuration.

What is claimed is:

1. A cushioning material that is arranged between a packed item and an outer box, the cushioning material comprising:

a base material that includes a main body portion which is brought into contact with a cushioned surface of the packed item and a bending part which is formed integrally with the main body portion so as to be able to be bent through a hinge line, the base material being arranged opposite the packed item; and a plurality of columnar support portions that are arranged in a plurality of places on a surface on an opposite side to a surface of the base material in contact with the cushioned surface of the packed item, wherein the plurality of columnar support portions comprise a first columnar support portion fixed to or formed integrally with the main body portion so as to protrude, in a thickness direction of the main body portion, from a face of the main body portion opposite from a face thereof in contact with the cushioned surface, and a second columnar support portion fixed to or formed integrally with the bending part so as to protrude, in a thickness direction of the bending part, from a face of the bending part opposite from a face thereof in contact with the cushioned surface, with one end portion of the second columnar support portion protruding toward the main body portion beyond the hinge line, and when the bending part is bent substantially perpendicularly with respect to the main body portion such that the bending part makes contact with another surface of the packed item adjacent to the cushioned surface, the first columnar support portion and the one end portion of the second columnar support portion both protrude from a surface of the main body portion toward a side surface of the outer box opposite the cushioned surface of the packed item by substantially the same amount of protrusion in a direction away from the packed item.

2. The cushioning material of claim 1, wherein the first and second columnar support portions are arranged in a vicinity of at least three edges of the base material in three different directions.

3. The cushioning material of claim 1, wherein the base material is formed with a corrugated cardboard sheet, and the first and second columnar support portions are each formed by stacking a plurality of corrugated cardboard sheet parts.

4. A cushioning material that is arranged between a packed item and an outer box, the cushioning material comprising:

a base material that includes a main body portion which is brought into contact with a cushioned surface of the packed item and a bending part which is formed integrally with the main body portion so as to be able to be bent through a hinge line, the base material being arranged opposite the packed item; and a plurality of columnar support portions that are arranged in a plurality of places on a surface on an opposite side to a surface of the base material in contact with the cushioned surface of the packed item, wherein the plurality of columnar support portions comprise a first columnar support portion fixed to or formed integrally with the main body portion so as to protrude, in a thickness direction of the main body portion, from a face of the main body portion opposite from a face thereof in contact with the cushioned surface, and a second columnar support portion fixed to or formed integrally with the bending part so as to protrude, in a thickness direction of the bending part, from a face of the bending part opposite from a face thereof in contact with the cushioned surface, when the bending part is bent substantially perpendicularly with respect to the main body portion such that the bending part makes contact with another surface of the packed item adjacent to the cushioned surface, the first and second columnar support portions both protrude from a surface of the main body portion by substantially the same amount of protrusion in a direction away from the packed item, the hinge line is formed with a cut line and a bending line, the cut line being convex in a direction of the main body portion and U-shaped as seen in plain view, the bending line connecting the cut line and an edge of the base material, and an edge of the second columnar support portion is arranged along the cut line.

* * * * *